US008081130B2

(12) United States Patent
Apostolos et al.

(10) Patent No.: US 8,081,130 B2
(45) Date of Patent: Dec. 20, 2011

(54) BROADBAND WHIP ANTENNA

(75) Inventors: John T. Apostolos, Lyndeborough, NH (US); Judy Feng, Nashua, NH (US); William Mouyos, Windham, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 412 days.

(21) Appl. No.: 12/436,375

(22) Filed: May 6, 2009

(65) Prior Publication Data

US 2010/0283699 A1 Nov. 11, 2010

(51) Int. Cl.
*H01Q 9/16* (2006.01)

(52) U.S. Cl. ..... 343/792; 343/791

(58) Field of Classification Search ..... 343/790, 343/791, 792

See application file for complete search history.

(56) References Cited

U.S. PATENT DOCUMENTS 3,576,578 A * 4/1971 Harper ..... 343/791
3,680,147 A * 7/1972 Redlich ..... 343/792
3,879,735 A * 4/1975 Campbell et al. ..... 343/792
4,963,879 A * 10/1990 Lin ..... 343/792
5,790,080 A 8/1998 Apostolos
6,323,814 B1 11/2001 Apostolos
6,359,599 B2 3/2002 Apostolos
6,373,440 B2 4/2002 Apostolos
6,373,446 B2 4/2002 Apostolos
6,404,391 B1 6/2002 Apostolos
6,480,158 B2 11/2002 Apostolos
6,492,953 B2 12/2002 Apostolos
6,985,121 B1 * 1/2006 Bogdans et al. ..... 343/792

* cited by examiner

*Primary Examiner* — Tho G Phan

(74) *Attorney, Agent, or Firm* — Daniel J. Long; Robert K. Tendler

(57) ABSTRACT

A shortened multi-band antenna includes in-line dipoles, selected elements of which having shielded meanderline chokes to be able to switch from an extended dipole at the lower VHF frequencies to a shortened dipole for the UHF band. Additionally, the staggered asymmetric meanderline configuration permits overall size reduction, whereas antenna construction includes an intermediate fiberglass layer over which conductive foil is placed for tuning and for parasitic radiator purposes to improve the gain of the UHF dipole in the upper regions of the band at 450 megahertz. Additionally, at the low end of the 30 megahertz band a sleeve is positioned between the base of the lowest dipole element and ground, with the sleeve provided with two parallel RLC circuits tuned to different bands to improve VSWR at the low end of the VHF band and to eliminate unwanted nulls.

20 Claims, 7 Drawing Sheets

BROADBAND WHIP ANTENNA

FIELD OF THE INVENTION

This invention relates to broadband communication antennas and more particularly to the utilization of meander line chokes and a vertically stacked series of dipoles to provide for continuous coverage from 30 megahertz up to above 2 gigahertz.

BACKGROUND OF THE INVENTION

The military, police and some commercial installations have vehicles that are provided with a virtual forest of antennas to cover various frequency bands. As a result there is a requirement for continuous coverage in a single antenna that operates between from the VHF bands at 30 megahertz all the way up to the 6 UHF gigahertz frequencies.

In order to be able to provide multi-band coverage, up to 4 or 5 antennas are separately utilized on a vehicle. The bands of interest for the military are the 30-88 megahertz band, the 108-156 megahertz band, the 225-450 megahertz band, the 1350-1550 megahertz band and the 1650-1850 megahertz band.

As mentioned above, there is a necessity for military, law enforcement and even commercial vehicles to be equipped with communication devices to permit operators to exchange information with a variety of different information services, command and control and dispatch centers. Also, GPS coverage is often required for geolocation. While these vehicles can employ multiple separate antennas designed to communicate effectively at a particular frequency range, there is a requirement for a single antenna that may be mounted to existing vehicles so that one antenna can have the gain of legacy antennas, while supplanting the forest of antennas previously utilized.

More particularly, a so-called Sincgars antenna typically operates between 30 megahertz and 88 megahertz, where the 30 megahertz legacy antenna has a −3 to −6 db gain over a ¼ wave monopole. The 30 megahertz legacy antenna is typically a monopole antenna whose gain is directly proportional to antenna volume. It is noted that for 30 megahertz, a quarter wavelength is 8 feet which makes a quarter wave antenna unusable in a wide variety of applications.

What is therefore required in addition to multi-band operation is an antenna whose overall height is no more than 4 or 5 feet.

It would therefore be desirable for instance to be able to replace the army AS3900A whip antenna with a single relatively short multi-band whip antenna that could provide the requisite gain.

One antenna capable of multi-band use is described in U.S. patent application Ser. No. 11/641,041 assigned to the assignee hereof. This antenna is designed to operate in the 30 to 88 megahertz band. However it is over 105 inches tall. Another problem with this antenna is that it is fabricated utilizing a number of sections of tubing that are screwed together. It has been found that these antennas are not readily fabricatable and deployable in the field due to the variability when screwing the sections together and due to the fact that from a storage point of view a 105 inch antenna is not practical.

Thus, especially for the Sincgars radio band, providing such an antenna, primarily for voice communications, has its problems. Moreover, when considering vehicle mounted antennas operating above a ground plane, variability in the ground plane configuration causes matching and radiation pattern problems because vehicle configurations can vary significantly. It therefore becomes critical as where on the vehicle to mount the antenna.

While it might be thought that any antenna could be tuned for each vehicle, such antennas are not practical and the simple solution is to simply avoid frequencies where VSWR is high, with the obvious coverage disadvantages.

Moreover, aside from its length and multi-part construction, it was found that standard meander lines used to separate out the bands did not adequately act as traps. Thus, while various dipoles were designed to operate in various bands, the traps did not function properly to switch from a short to a trap at the band demarcations.

Secondly, especially in the middle and upper bands, the prior antenna did not exhibit sufficient gain so that the antenna could not match or exceed legacy antennas.

Further, it was found that in shortening the prior antenna, linearly downsizing the meander lines did not result in the either sufficient gain or sufficiently low VSWR.

Moreover, it was almost impossible to tune the meander lines once in place. The result was that pre-tuned antennas would not exhibit the required tuning when vehicle mounted.

Finally, the antenna could not pass the so-called oak-beam test, in which the antenna is to withstand repeated impact with an oak beam at 30 mph.

For these reasons the antenna design described in the aforementioned patent applications had to be abandoned and a new antenna had to be designed that would solve the problems noted above.

By way of further background, it has been proposed to miniaturize antennas by using so-called meander line loaded antennas exemplified by U.S. Pat. Nos. 5,790,080; 6,323,814; 6,373,440; 6,373,446; 6,480,158; 6,492,953 and 6,404,391, all assigned to the assignee hereof and incorporated herein by reference. While these meander lines have been utilized in the past for impedance matching and tuning purposes, they were not utilized to provide chokes or traps between various dipole segments so as to make a single whip operate in a multi-band mode.

SUMMARY OF INVENTION

In order to solve the multiple antenna problems noted above, in the subject invention a series of dipoles are mounted one on top of the other in which the antenna consists of a number of coaxially-located tubular sections, with gaps in the tubing either providing feed points for the associated dipole or for the interposition of shielded meander lines that properly perform as chokes or traps. As a result, as one moves up in frequency, one coverts the antenna structure from a 30-190 hertz dipole to a 225-240 megahertz dipole and then to a 700 megahertz to 2 gigahertz dipole, with the chokes or traps providing for the distinct antennas.

Moreover, in order to reduce the overall height from 105 inches to 5½ feet, rather than using traditional meander lines, staggered shielded meander lines are utilized to provide better choking or trap functions.

Specifically, it was found that one could not reduce the overall size of the multi-element antenna of Ser. No. 11/641,041 by simply scaling the meander lines. Rather it was found that a stagger tuning arrangement for the meanderlines was needed that involved utilizing the lower meander line in tact, but shortening the upper meander line to approximately 70% of the size of the initially designed meander line.

In particular, the effective length of the broadband whip antenna as a function of frequency is constructed to never exceed 1.2 wavelengths from 30 to 450 megahertz. This constraint guarantees there will always exist a main lobe on the horizon. In one embodiment, at 30 megahertz the effective antenna length is 62 inches, whereas from 240 to 450 megahertz the effective length is 22 inches.

The effective length condition is maintained by the use of folded or shielded meanderline structures inserted at strategic points along the whip. The folded meanderline structures approximate so called photonic band gap devices which are periodic resonant structures. Such devices have alternating band pass/band stop characteristics as a function of frequency. At about 220 MHz the meanderline transfer function enters the band stop region. A smooth transition in the 240 MHz region is accomplished by utilizing the above-mentioned stagger tuned meanderline structures.

More particularly, the meanderlines are two fold periodic. The only practical way to integrate the meanderlines on the antenna is to use a folded or shielded configuration. The periodic meander lines must have identical folds to achieve the ideal transfer function. Because the folds are stacked one above the other, the inner fold sees the shielding effect of the outer fold. This shielding effect causes the inner fold to have more delay than the outer fold. For optimum performance the two folds should have the same delay. Thus, the inner fold must be physically shortened.

As to meanderline impedance, the impedance across the respective meanderlines is such that the upper meanderline choke response is shifted to higher frequencies because of the shorter length.

At lower frequencies both lines act as shorts and have zero impedance, while at high frequencies the impedance of both meanderlines is high to achieve the trap or choke function.

At about 230 megahertz the lower meanderline starts to act as a choke while the upper meanderline is at a low impedance, i.e. forms a short. Under this condition the antenna acts like a asymmetrical dipole from the lower meanderline to the top of the antenna.

At about 280 megahertz the upper meanderline starts to act as a choke such that both meanderlines act as chokes. Under this condition the antenna acts like a asymmetrical dipole between the two meanderlines.

If the meanderlines are the same length, the transition from a full antenna to an abbreviated antenna leads to Gibbs oscillations in the antenna gain.

The above staggered configuration solves this problem by being asymmetric as an intermediate state so that the transition from a full antenna to an abbreviated antenna is more gradual, mitigating the oscillation problem.

Additionally, at the low end of the 30 megahertz band a tuning sleeve is positioned between the base of the lowest element and the ground plane, with the tuning sleeve being provided with two parallel RLC circuits tuned to different bands. The purpose of the sleeve with the RLC circuits is to eliminate an unwanted null and provide low VSWR at the low end of the VHF band.

Moreover, it was found that a parasitic re-radiator can be formed at the top of the 225-450 MHz dipole to provide improved gain especially for the upper region of the UHF band.

What is therefore made possible by the above improvements to the originally designed vehicular multi-band antenna of U.S. patent application Ser. No. 11/641,045 is that the antenna itself is of a unitary construction in which the cylindrical elements of the dipoles are stacked one on top of the other without having to screw together antenna segments.

Secondly, the overall height of the antenna is reduced from 105 inches to 66 inches which is ⅔rds of the height of the originally designed antenna.

Fourthly, staggered shielded meanderlines permit antenna shortening without unwanted oscillations.

Thirdly, shielded meander lines provide effective chokes or traps, where unshielded meander lines failed.

Additionally, the utilization of a base tuning sleeve results in a better VSWR at the low end of 30 megahertz band.

In operation, from 30 to 190 megahertz a center-fed dipole is made up of 4 cylindrical elements, one on top of the other. In this case the shielded meander line chokes act as shorts between the lower two and the upper two dipole elements to provide a long dipole.

As one precedes above 190 megahertz the two shielded meander lines, rather than performing a shorting function, transition to open at these frequencies resulting in a shorter dipole antenna operating at 225-450 megahertz. Here the antenna only utilizes the center two elements of the 30-190 megahertz dipole. Over 450 megahertz the four tubular antenna elements previously described have virtually no effect on a top mounted dipole operating between 700 megahertz and 2 gigahertz.

Thus the antenna has three in-line dipoles, with the lower band dipole consisting of four elements, pairs of which being electrically shorted together to form the 30 MHz to 190 MHz dipole. Thereafter, the center elements of this dipole are the only ones that are active in the 225 to 450 megahertz band, with the other elements electrically open with respect to this dipole.

Finally, all of the above mentioned elements are electrically isolated from a top 700 megahertz to 2 gigahertz dipole. Note all the antenna elements are in-line and coaxially aligned in a single vertically stacked package, with the tubular elements surrounded in one embodiment by wrapped fiber glass. It has also been found that an intermediate fiber glass wrapping layer with overlying copper tape may be conveniently utilized to tune the dipoles for each vehicle mounting scenario. Moreover, a ground plane like sleeve may be placed over the intermediate fiberglass layer below the L band dipole to reflect the L band beam upward.

In summary, a shortened multi-band antenna includes in-line dipoles, selected elements of which having shielded meanderline chokes to be able to switch from an extended dipole at the lower VHF frequencies to a shortened dipole for the UHF band. Additionally, the staggered asymmetric meanderline configuration permits overall size reduction, whereas antenna construction includes an intermediate fiberglass layer over which conductive foil is placed for tuning and for parasitic radiator purposes to improve the gain of the UHF dipole in the upper regions of the band at 450 megahertz. Additionally, at the low end of the 30 megahertz band a sleeve is positioned between the base of the lowest dipole element and ground, with the sleeve provided with two parallel RLC circuits tuned to different bands to improve VSWR at the low end of the VHF band and to eliminate unwanted nulls.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
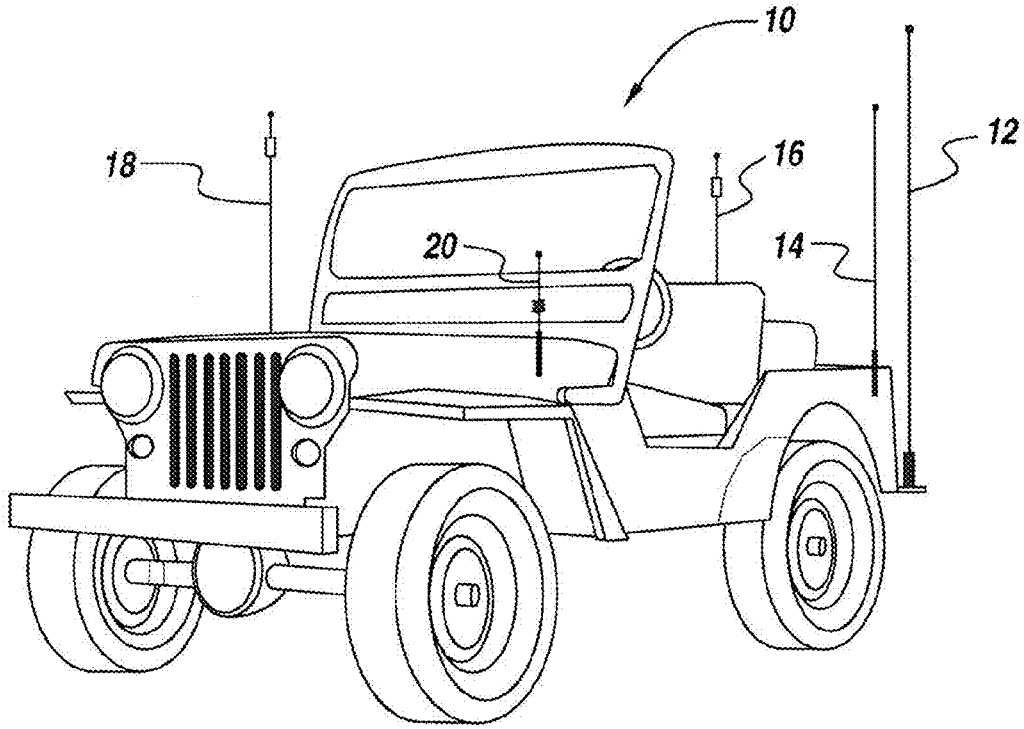
Fig. 1 Prior Art
FIG. 1 is a diagrammatic illustration of prior art antenna vehicle mounting in which a virtual forest of antennas is provided on the vehicle to provide appropriate multi-band coverage.

Referring now to FIG. 1, in the prior art, a vehicle 10 is normally provided with a number of antennas 12-20 tuned to various bands. The fact of having to provide a vehicle with such a large number of antennas for multi-band coverage is problematical and it had been proposed to have an elongated whip, here shown as monopole 12, loaded up to accommodate various bands.

Figure 2:
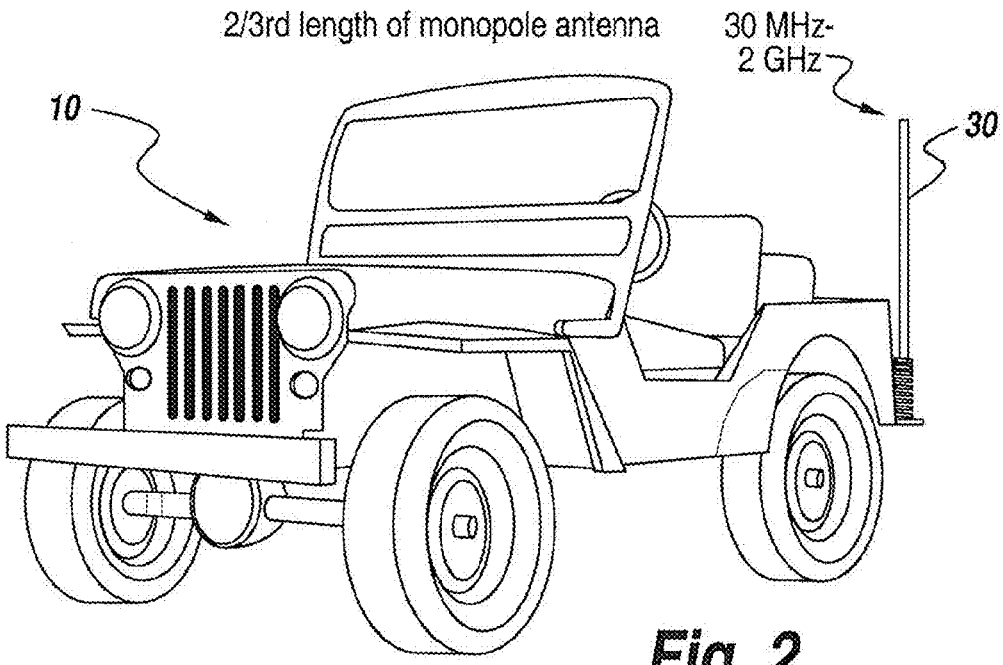
FIG. 2 is a diagrammatic illustration of the subject antenna which is two-thirds the length of the monopole antenna of FIG. 1 and operates between 30 megahertz and 2 gigahertz to provide multi-band coverage.

However, the length of the whip as well as the inefficiencies of providing such a wideband bottom-loaded whip had led to the development of the multi-band antenna described above. This multi-band antenna also had deficiencies which resulted in the development of the subject shortened whip antenna shown in FIG. 2.

Here an antenna 30 is mounted to a vehicle 10 in which the overall length of the antenna is ⅔rds of the length of the prior multi-band antenna described in the above patent applications. The coverage of the subject antenna is from 30 megahertz to 2 gigahertz. Note that this antenna is in the form of a single, unitary, relatively short whip for multi-band communications across a wide frequency spectrum.

Figure 3:
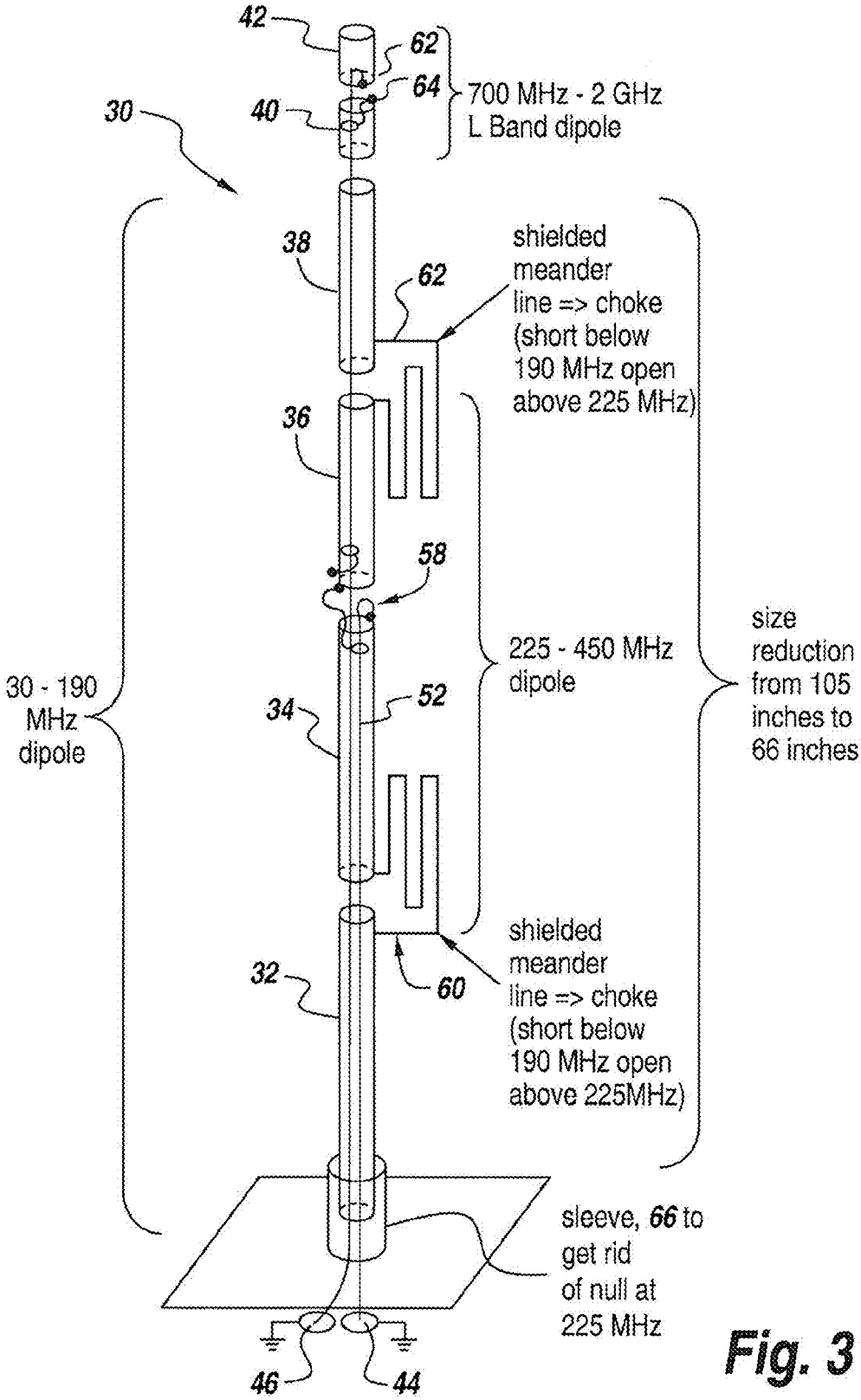
FIG. 3 is a diagrammatic illustration of the subject antenna in which in-line dipole elements are located one on top of the other above a ground plane in which the center two elements are connected to adjacent outboard elements with shielded meanderlines to provide a choke or trap function such that the center two elements form a 225-450 megahertz dipole, with the four elements providing a 30-190 megahertz dipole when the shielded meanderlines act as shorts, also showing an L band dipole located in-line above the other dipole elements.

As shown in FIG. 3, antenna 30 is made up of in-line dipole elements or radiators 32, 34, 36, 38, 40 and 42 which are driven at feed points 44 and 46 to provide the indicated coverage.

As indicated, a shortened dipole is composed of dipole elements 34 and 36 fed at feed point 50, with the center conductor 52 of a coaxial feed line being coupled to element 34, whereas the ground for this coax is coupled to element 36.

In order to provide a dipole antenna operable from 30 megahertz to 190 megahertz, elements 32 and 38 are shorted to respective adjacent elements 34 and 36 utilizing a shielded meanderline system. At these frequencies, the shielded meanderline 60 shorts element 32 to element 34, whereas shielded meanderline 62 shorts element 36 to element 38. This provides an elongated dipole over 30-190 MHz. Note that the shielded meanderlines are designed to form a short below 190 megahertz, whereas at the lower meanderline starts to go open above 225 megahertz. At this time the upper meanderline functions as a short. This results in an asymmetrically fed dipole, with elements 32, 34 and 36 having an effective length to cover a 225-280 MHz frequency range. Thereafter, upper meanderline 62, being shorter than the lower meanderline, opens up so that the dipole corresponds to elements 34 and 36 to cover 280 MHz to 450 MHz. Note at this time the dipole is a symmetrically fed dipole.

This staggered meanderline tuning eliminates Gibbs oscillations and makes possible shortening of the antenna. Thus, the action of the meanderlines is to shorten the elongated VHF band dipole for frequencies above 225 MHz.

It will be seen that four in-line dipoles elements are coaxially located and stacked one on top of another, with the shielded meanderline chokes providing the switching between an elongated dipole and foreshortened dipoles.

Also shown is an in-line L band 700 megahertz-2 gigahertz dipole antenna having elements 40 and 42. This dipole is fed by coax which runs up through elements 32-38 and has its center connector 62 coupled to element 42, whereas its ground shield 64 is coupled to element 40.

As will be discussed, the subject design results in a size reduction from 105 inches which was the length of the prior multi-band antenna to 66 inches due to the shielded meanderline structure and more particularly to the staggered asymmetrical meanderline configuration.

Also shown in this figure is a sleeve 66 to eliminate a null at 225 megahertz and to improve to VSWR at the low end of the 30 megahertz band. The construction of the sleeve will also be discussed hereinafter.

Figure 4:
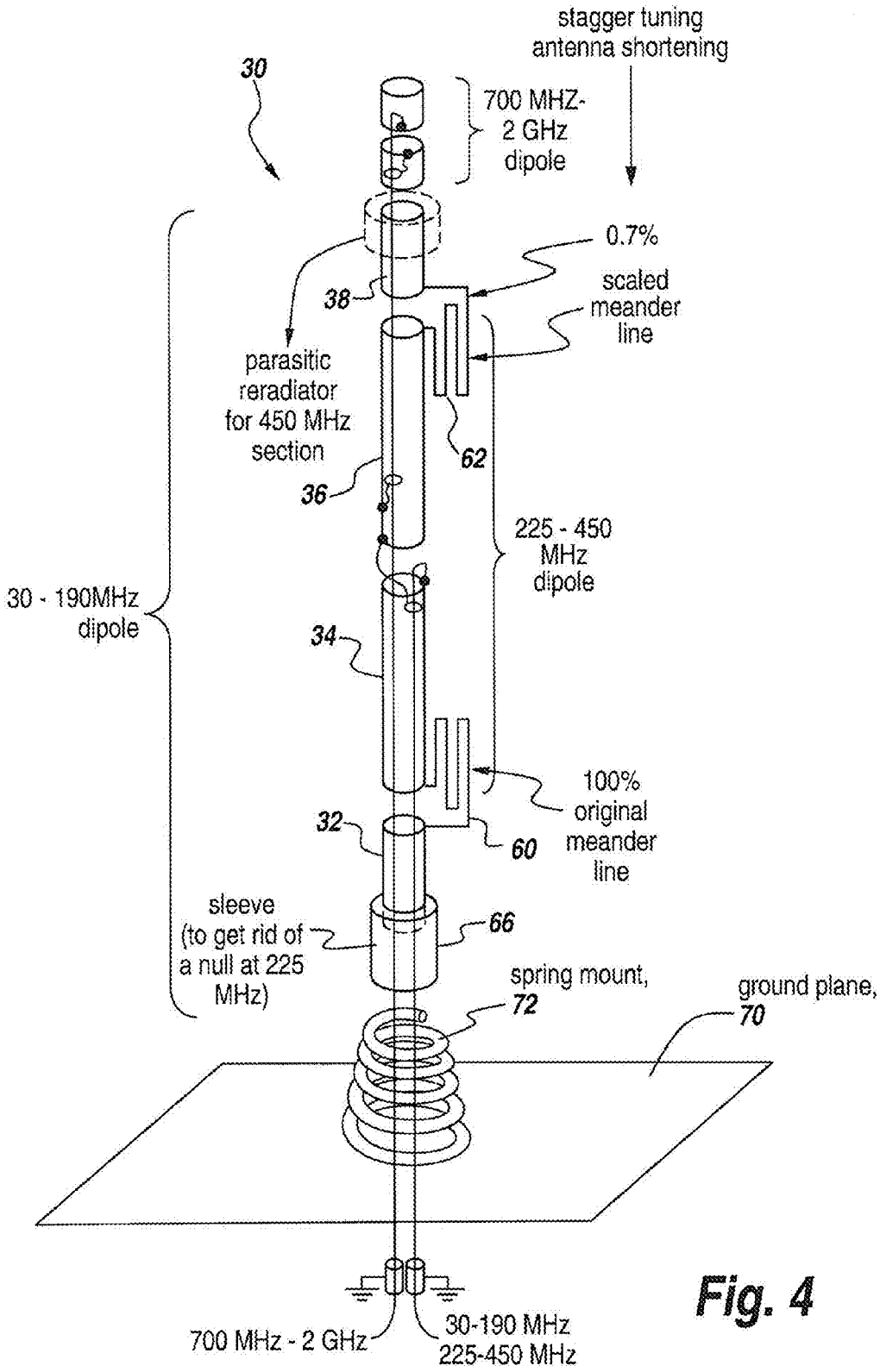
FIG. 4 is a diagrammatic illustration of the antenna of FIG. 3 showing the staggered meanderline structure.

Referring now to FIG. 4, in which like elements carry like reference characters, it can be seen that antenna 30 is located above a ground plane 70, i.e. the vehicle body, and is spring mounted as illustrated at 72.

Also shown in this figure is a parasitic re-radiator for the 450 megahertz section of this antenna, namely section 38. This parasitic element is a cylindrical foil spaced from and wrapped around the distal end of element 38. The purpose of this parasitic re-radiator is to provide improved gain at the upper end of the UHF band namely at around 450 megahertz.

Central to the ability to shorten the prior 105 inch antenna is the use of so-called scaled meanderlines in a stagger tuning arrangement whereby meanderline 60 is the same size as its original design, but meanderline 62 is scaled to approximately 70% of its originally-designed size. This shifts its choke frequency upward to approximately 280 MHz.

It is noted that the effective length of the subject broadband antenna as a function of frequency is constrained to never exceed 1.2 wavelengths from 30 to 450 megahertz. This constraint guarantees that there will always exist a main lobe on the horizon.

Figure 8:
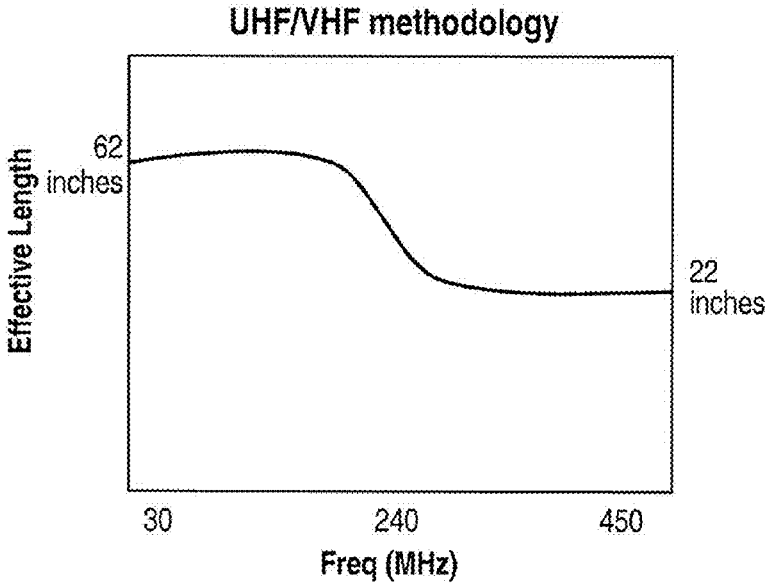
FIG. 8 is a graph of effective antenna length versus frequency showing a gentle, effective length transfer from 62 inches to 22 inches about the 240 megahertz frequency.

As seen in FIG. 8, the effective length of the subject antenna varies from approximately 62 inches at frequencies from 30 megahertz to 225 megahertz and goes down to 22 inches for frequencies at or above 280 megahertz.

The above-noted effective length is maintained by use of folded meanderline structures inserted at strategic points along the antenna. The folded meanderline structures approximate photonic band gap devices which are periodic resonant structures. Such devices have alternating band pass/band stop characteristics as a function of frequency. At about 225 megahertz the meanderline transfer function of the lower meanderline enters the band stop region from an essentially shorting condition. The smooth transition in the 240 megahertz region is accomplished by utilizing the above-mentioned stagger tuned meanderline structures, with the stagger tuning offering the smooth transition function and preventing oscillations.

As can be seen, the meanderlines are two-fold periodic. The only practical way to integrate the meanderlines on the whip is to use a folded configuration. The periodic meanderlines must have identical folds to achieve the ideal transfer function. Because the folds are stacked one above the other, the inner fold sees the shielding effect of the outer fold. This shielding effect causes the inner fold to have more delay than the outer fold. For optimum performance the two folds should have the same delay. Thus, the inner fold must be physically shortened as illustrated.

Figure 6:
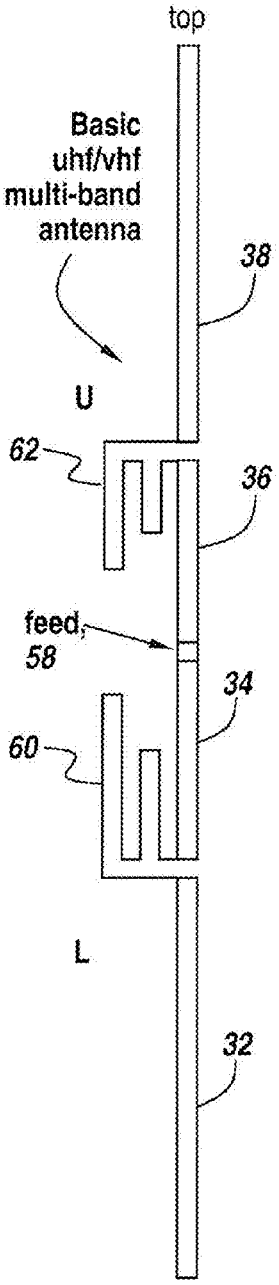
FIG. 6 is a schematic diagram of the basic UHF/VHF multi-band antenna showing the placement of the shielded meanderlines between adjacent dipole elements.

Referring now to FIG. 6, the two meanderlines 60 and 62 are shown bridging elements 32 and 34, and 36 and 38 respectively. Meanderline 60 is labeled L for the lower meanderline, whereas meanderline 62 is labeled U for the upper meanderline. The feed point 50 is as noted.

Figure 7:
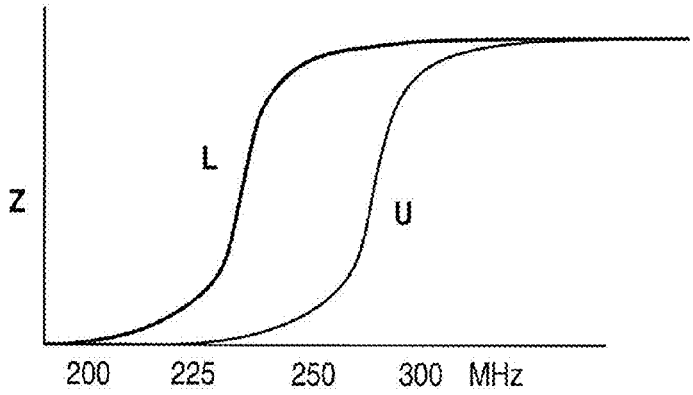
FIG. 7 is a graph of impedance versus frequency for the shielded meanderline chokes of FIG. 6.

Referring to FIG. 7 when impedance Z is graphed against frequency for these two meanderlines, the upper meanderline's choke response is shifted to higher frequencies because of the shorter length. At lower frequencies both the lower and upper have zero impedance, Z, while at higher frequencies the impedance is high. It will be noted that as can be seen in FIG. 6 meanderline 60 is longer than meanderline 62.

In operation, at about 225 megahertz the lower meanderline goes from a short to a choke, while the upper meanderline is still in a low impedance short condition. Under this condition the multi-band antenna acts like an asymmetrically fed dipole from the lower meanderline to the top of the VHF/UHF antenna.

At about 280 megahertz the upper meanderline stops conducting, making both the upper and lower meanderlines function as chokes. Under this condition the antenna acts like a shortened symmetric dipole between the upper and lower meanderlines.

If the upper and lower meanderlines are the same length, the transition from full antenna length to abbreviated antenna length is abrupt, leading to Gibbs oscillations in the antenna gain.

However the staggered configuration exhibits the asymmetric case as an intermediate state, so that the transition from a full length antenna to an abbreviated length antenna is more gradual, mitigating the oscillation problem.

Thus as can be seen from FIG. 7, the lower meanderline starts to become a choke at about 225 MHz, whereas the upper meanderline being shorter, provides a choking or trap action at about 280 megahertz.

Put another way, the lower meanderline acts as a short below 225 megahertz as does the upper meanderline. However the lower meanderline starts to exhibit a choke or trap function at or about 225 megahertz presenting a virtual open circuit between elements 32 and 34. At this time however, the upper meanderline still functions as a short. At or about 280 megahertz the upper meanderline starts to act as an open or function as a choke, whereas both meanderlines at or above this 280 megahertz region act to disconnect the elements 32 and 38 from adjacent dipole components to form the shortened dipole.

Figure 5:
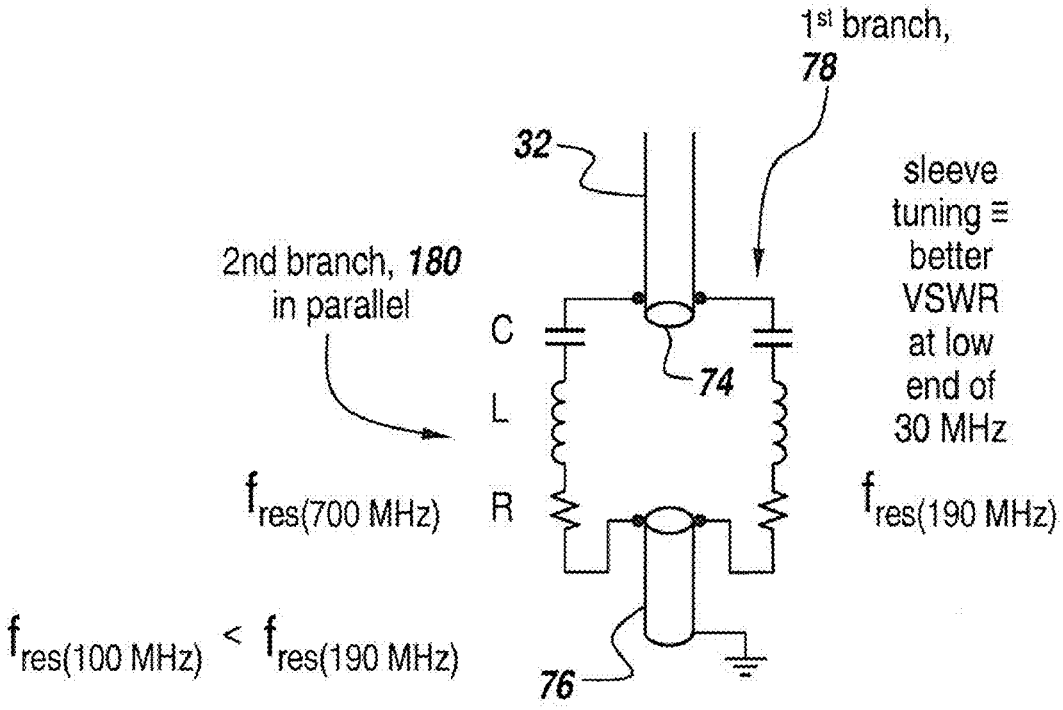
FIG. 5 is a schematic diagram of the base sleeve which can incorporate parallel RLC circuits tuned to different frequencies for improving VSWR at the low end of the 30 megahertz band.

Referring back to FIGS. 3, 4 and 5, as can be seen from the schematic diagram, the sleeve has two internal RLC circuits which are connected in parallel between an end 74 of element 32 and a ferrule grounded at 76.

Here it can be seen that the RLC circuit of the first branch 78 is resonant at about 190 megahertz, whereas the resonant frequency of the second branch 80 in parallel with the first branch is at about 100 megahertz.

The purpose of these two parallel RLC circuits and the tuning sleeve is to achieve better VSWR at the low end of the 30 megahertz band and also to eliminate the nulls at 225 megahertz that were found to exist.

Figure 9:
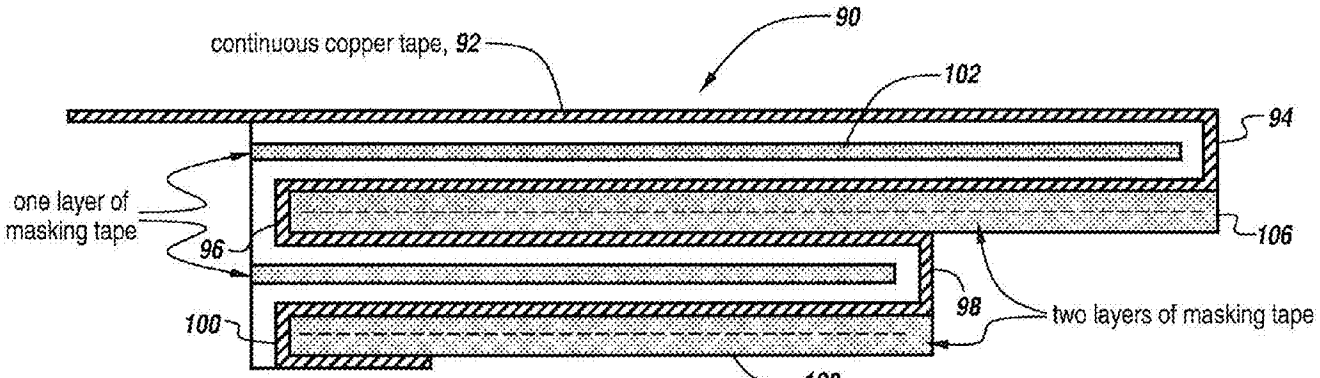
FIG. 9 is a diagrammatic illustration of the construction of the shielded meanderlines including a continuous copper tape snaked back and forth with layers of masking tape between the folds.
Figure 10:
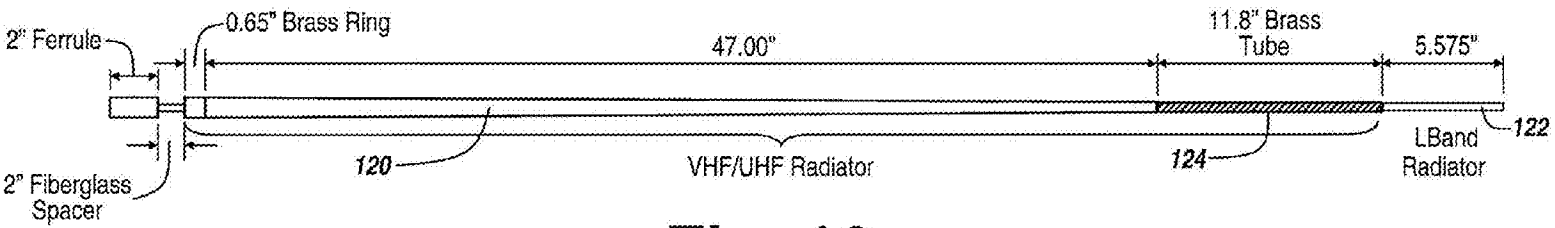
FIG. 10 is a diagrammatic illustration of the construction of the subject multi-band antenna including the provision of a fiberglass inner tube mounted to a brass ring and a ferrule at one end and a brass tube that forms one of the dipole elements.

Referring now to FIG. 9 and more particularly to the construction of this shielded meanderline structure, what is seen here is a meanderline 90 that is formed of a continuous flaked tape 92 which is folded on itself at a fold 94, again at 96, again at 98 and finally at 100, with the copper tape being insulated from adjacent folds through the utilization of masking tape. In one embodiment, a single layer of masking tape 102 is used between the top folded layers, whereas the same single layer is also used as shown at 104 between the bottom folded layers.

A double layer of masking tape is shown to insulate the meanderline material adjacent folds 96 and 100 from each other. This structure thus provides a relatively thin structure which when placed adjacent respective dipole elements does not protrude out significantly or bulge.

Referring now to FIGS. 10-14, one method of manufacturing the subject antenna starts with the utilization of an internal tube assembly here illustrated at 120. Note that there are two coax feed lines that make up the feed of the antenna and are internal to the internal tube assembly. The outer jackets of the two coax lines are shorted together at the base of the antenna and their other connections are clearly shown in FIG. 3. It is noted that the internal feed is carefully fed through the internal tube assembly. Thereafter, the VHF/UHF and L band feeds are prepared for their respective radiators in this assembly step. Thereafter, they are attached to their respective radiators.

In one embodiment, the VHF/UHF coax extends approximately half way up the internal tube assembly structure and feeds the VHF/UHF radiator through a small hole in the fiberglass tube. Thereafter the center conductor of the VHF/UHF coax is prepared and is attached to the bottom section of the VHF/UHF radiator. Thus, the outer conductor is prepared and is attached to the top section of the VHF/UHF radiator. This feeding scheme is known as the reverse feed approach and is unique to the subject invention.

The L band coax extends beyond the VHF/UHF coax and feeds the L band radiator through a hole in the L band radiator internal tube assembly 122.

It will be seen that in order to provide the VHF/UHF radiator with the proper length, a brass tube 124 is attached to internal tube assembly 120 which as will be seen is to be connected to the foil wraps that form the upper dipole radiator. As can be seen, the outer conductor of the L band coax is shorted to the brass tube via a short length of copper braid.

Figure 11:
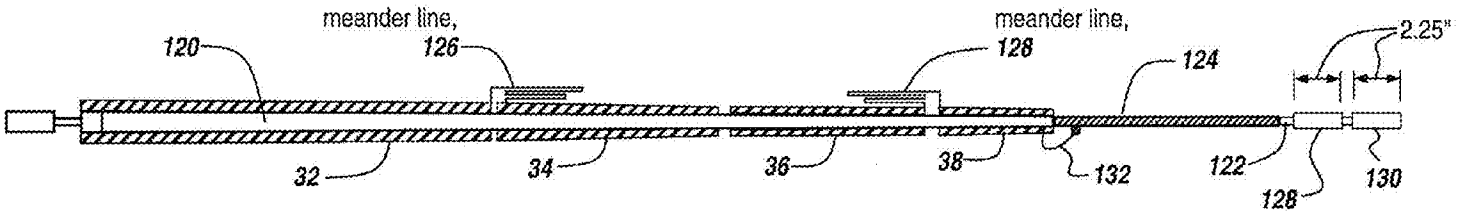
FIG. 11 is a diagrammatic illustration of the construction of the antenna of FIG. 10 illustrating the provision of shielded meanderlines between adjacent dipole sections to either side of the VHF/UHF feed point.

This short is realized through a hole in the brass tube that occurs below the top of the brass tube Referring now to FIG. 11, dipole radiator elements 32, 34, 36 and 38 in one embodiment, are made by wrapping foil around internal tube 120; and meanderlines 126 and 128 are attached between the indicated adjacent radiator elements. It will be appreciated that element 38 is electrically attached to brass tube 124 via solder or shorting link as illustrated at 132 to provide this required dipole element length. Otherwise, in another embodiment, the brass tube is not used and element 38 is extended over an extended internal tube.

Also shown is the L band dipole composed of elements 128 and 130 mounted to internal tube 122.

Figure 12:
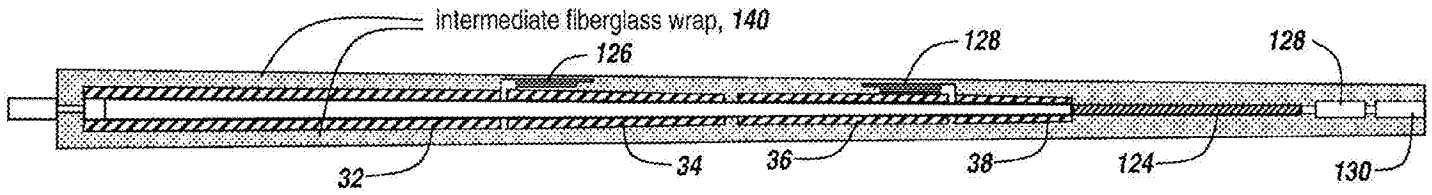
FIG. 12 is a diagrammatic illustration of the antenna of FIG. 11, illustrating the overlying of the dipole elements and the meanderlines with an intermediate fiberglass wrap.
Figure 13:
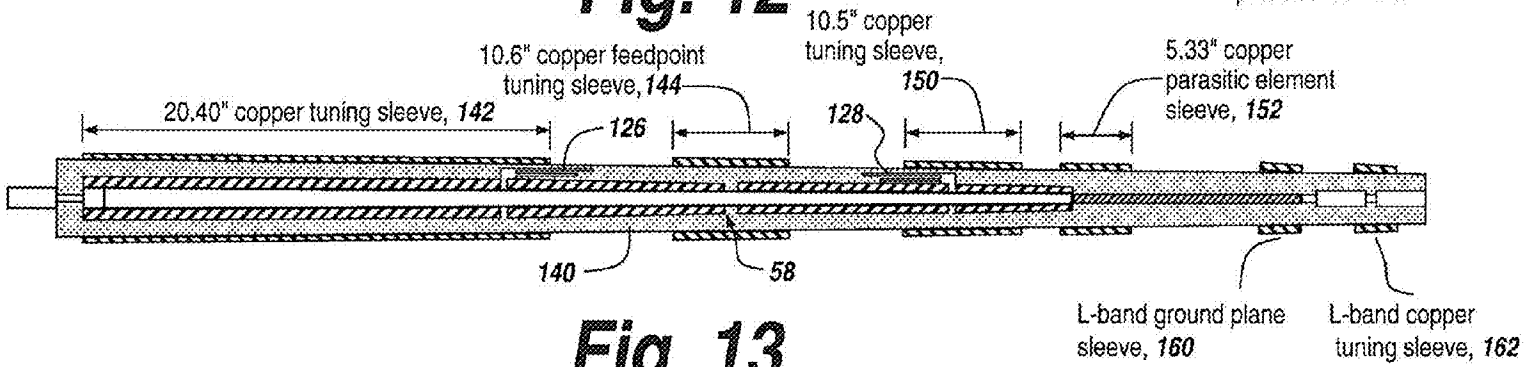
FIG. 13 is a diagrammatic illustration of the antenna of FIG. 12, illustrating the utilization of copper tuning sleeves over meanderline elements, and the VHF/UHF feed point, also showing a parasitic element sleeve placed on top of the intermediate fiberglass wrap for improving the upper end gain of the UHF dipole; and, FIG. 14 is a diagrammatic illustration of the antenna of FIG. 14, showing the over-wrapping of the entire structure of FIG. 13 with an outer fiberglass wrap.

Referring now to FIG. 12, an intermediate fiberglass wrap 140 surrounds all of the elements described above and as shown in FIG. 13 an elongated copper tuning sleeve overlies the intermediate wrap 140 above meanderline 126. A copper feed point tuning sleeve 144 overlies feed point 58, whereas copper tuning sleeve 146 overlies meanderline 128.

Finally, a parasitic element can be provided by a parasitic element sleeve 152 which surrounds a portion of the upper element of the VHF/UHF antenna.

Moreover, with respect to the L band antenna, it is possible to overlie the intermediate fiberglass layer with an L band ground plane sleeve 160 below the L band antenna that serves to angle the beam from the L band antenna in an upward direction. Additionally, it is possible to provide the L band antenna with an L band copper tuning sleeve 162 for tuning the feed point in the same way that copper feed point tuning sleeve 144 is used to tune the feed point of the VHF/UHF dipole.

Figure 14:
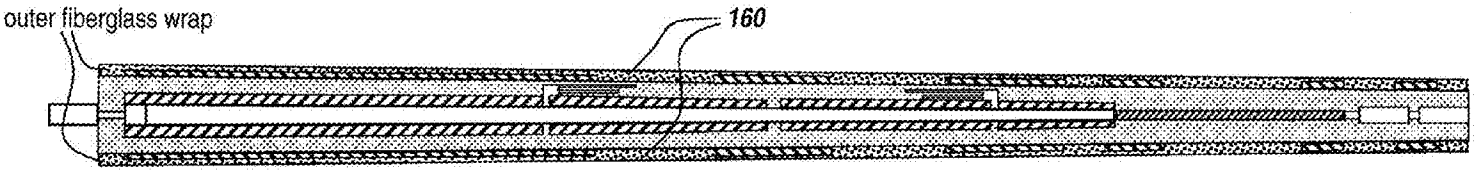

It is a feature of these overlaying sleeves that they can be formed by wrapping copper foil or tape around the intermediate fiberglass wrap and can be used to tune the various elements of the antenna in a convenient way prior to applying an outer fiberglass wrap 160 as illustrated in FIG. 14 to complete this antenna.

The above construction method provides an extremely robust antenna capable of surviving the oak-beam test, and is easily tunable through the utilization of the sleeves wrapped about the intermediate fiberglass wrap.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A multi-band whip antenna comprising:

a dipole including a number of in line tubular sections, a central pair of tubular sections having a gap there between to provide a feed point for the dipole;

a pair of tubular sections adjacent said central pair of tubular sections and spaced therefrom to form gaps;

a pair of staggered meanderlines serving as chokes respectively across the non-feed point gaps between tubular sections, said staggered meanderlines functioning to provide an asymmetric meanderline configuration, said meanderlines tuned such that one meanderline has an associated choke response frequency above that of the other meanderline for minimizing Gibbs oscillations; and, a coaxial feed line running up through selected tubular sections and having an inner conductor coupled to one of the tubular sections forming said feed point and an outer conductor coupled to the other tube section forming said feed point, whereby as the frequency of an input signal is increased first one meanderline goes from a shorting condition to an open condition at a frequency below the other of said meanderlines, said meanderlines functioning to provide a foreshortened dipole above a first frequency and an elongated dipole below a second frequency.

2. The antenna of claim 1, wherein the dipoles established by said tubular sections never exceed 1 to 2 wavelengths over the operating range of said antenna.

3. The antenna of claim 1, wherein said meanderlines include shielded meanderlines.

4. The antenna of claim 1, and further including a ferrule at the base of the lowest of said tubular sections, said ferrule housing at least two RLC circuits, said circuits connected in parallel between the lowest of said tubular sections and ground and tuned to different resonant frequencies for improving the VSWR performance of said dipole at the lower operating frequencies of said dipole.

5. The antenna of claim 4, wherein said dipole operates between 30 to 450 megahertz and wherein said parallel circuits are tuned respectively to 100 megahertz and 190 megahertz thereby to eliminate a dipole null at 225 megahertz.

6. The antenna of claim 1, wherein said tubular elements, feed point and meanderlines are provided with an outer wrapped intermediate layer, and further including conductive material over said intermediate layer above respective meanderlines and feed point for the tuning of said meanderlines and feed point, whereby said antenna may be tuned after initial fabrication and after said antenna is provided with an outer wrapped intermediate layer.

7. The antenna of claim 1, wherein said intermediate layer includes fiberglass.

8. The antenna of claim 1, and further including a parasitic re-radiator on top of and insulated from the top tubular section so as to improve the gain of the antenna.

9. The antenna of claim 1, wherein said staggered meanderline configuration includes a lower meanderline and a upper meanderline shorter than said lower meanderline.

10. The antenna of claim 9, wherein said upper meanderline is scaled to 70% of the lower meanderline.

11. The antenna of claim 1, and further including an additional dipole having tubular elements mounted inline above said first mentioned dipole elements, and further including a separate coaxial line running from the base of said antenna up through said tubular sections to the feed point of the tubular sections constituting said additional dipole, the center conductor of said separate coaxial line coupled to one of said additional tubular dipole sections and the outer conductor of said separate coaxial line coupled to the other of said additional tubular dipole sections.

12. The antenna of claim 11, and further including means to connect the outer conductor of said separate coaxial line to the tubular section of said first mentioned dipole to which the outer conductor of said first mentioned coaxial cable is connected.

13. The antenna of claim 11, wherein said additional dipole is an L band dipole.

14. The antenna of claim 13, wherein said antenna from base to the top of said L band dipole is less than 105 inches.

15. The antenna of claim 13, wherein the size of said antenna is reduced to less than 65% of a meanderline-choked antenna not using staggered meanderlines.

16. The antenna of claim 11, wherein said additional antenna includes a sleeve below said additional antenna which serves to reflect the beam from said additional antenna upward.

17. The antenna of claim 16, wherein said additional antenna is an L band antenna and wherein said sleeve functions as an L band sleeve for reflecting the beam from said L band antenna upward.

18. The antenna of claim 1, wherein said dipole operates in the VHF/UHF bands.

19. The antenna of claim 18, wherein said dipole has four tubular sections, wherein said VHF band covers 30 to 190 megahertz and uses all four tubular sections, wherein said UHF band covers 225 to 450 megahertz and wherein said antenna utilizes only the center two of said four tubular sections to cover the UHF band.

20. The antenna of claim 1, wherein the use of staggered meanderlines permits the reduction of antenna height over meanderline-choked dipole antennas not utilizing staggered meanderlines.

* * * * *